United States Patent [19]

D'Augustine et al.

[11] 4,445,874

[45] May 1, 1984

[54] APPARATUS AND METHOD FOR ALIGNING THE ENVELOPE AND ELECTRON GUN MOUNT ASSEMBLY OF A CRT

[75] Inventors: Frank T. D'Augustine; Randal L. Berardi, both of Lancaster, Pa.

[73] Assignee: RCA Corporation, New York, N.Y.

[21] Appl. No.: 348,022

[22] Filed: Feb. 11, 1982

[51] Int. Cl.[3] ..... H01J 9/18

[52] U.S. Cl. ..... 445/45; 445/67

[58] Field of Search ..... 445/63, 64, 45, 34, 445/67; 269/908

[56] References Cited

U.S. PATENT DOCUMENTS

| | | | |
|---|---|---|---|
| 3,594,059 | 7/1971 | Holz | 445/67 |
| 3,807,006 | 4/1974 | Segro et al. | 29/25.13 |
| 3,962,764 | 6/1976 | Stachel et al. | 445/45 |
| 3,962,765 | 6/1976 | Stewart et al. | 445/45 |
| 4,189,814 | 2/1980 | Ottos | 29/25.16 |
| 4,200,274 | 4/1980 | Turner | 269/319 |

FOREIGN PATENT DOCUMENTS

| | | | |
|---|---|---|---|
| 53-144659 | 12/1978 | Japan | 445/45 |
| 55-108145 | 8/1980 | Japan | 445/45 |
| 56-63745 | 5/1981 | Japan | 445/64 |
| 2039143 | 7/1980 | United Kingdom | 445/45 |

*Primary Examiner*—Kenneth J. Ramsey
*Assistant Examiner*—Kurt Rowan
*Attorney, Agent, or Firm*—Eugene M. Whitacre; Dennis H. Irlbeck; Lester L. Hallacher

[57] ABSTRACT

An abstract for aligning a CRT envelope and the electron gun mount to be inserted into the envelope neck includes fixed members to which the gun mount and envelope are referenced. The envelope is supported at a desired location and in a particular orientation with respect to the reference members. The envelope is rotated to bring the panel sides into a particular position with respect to the reference members. The envelope and gun mount are thus properly aligned.

12 Claims, 3 Drawing Figures

APPARATUS AND METHOD FOR ALIGNING THE ENVELOPE AND ELECTRON GUN MOUNT ASSEMBLY OF A CRT

BACKGROUND OF THE INVENTION

This invention relates generally to the production of cathode ray tubes (CRT) and particularly to an apparatus and method for aligning the envelope panel and electron gun mount assembly of such tubes.

During the initial stages in the production of a cathode ray tube, a phosphor screen is placed on the inside surface of a faceplate panel. A shadow mask, which serves as a color selection electrode, is then placed into the panel. The panel and a glass funnel which tapers into a neck, are then fitted together to form a completed envelope. An electron gun mount assembly is inserted into the neck and the envelope is evacuated and sealed.

During the operation of a color kinescope, the electron guns direct three electron beams toward the screen. The electron beams pass through the shadow mask at different angles so that each beam impacts a phosphor element of a different color emission resulting in the generation of a color visual display on the screen. Because the beams must approach the screen at the proper angles, it is necessary for the electron gun to be properly oriented with respect to longitudinal axis of the panel. Also, because the electron beams are scanned horizontally and vertically across the phosphor screen, the electron gun must be properly oriented with respect to the horizontal and vertical axes of the screen.

U.S. Pat. No. 4,189,814 discloses an apparatus for aligning the electron gun mount assembly and the neck of a CRT envelope. The apparatus described in this patent includes an upper support and a lower support which respectively support the CRT funnel and the electron gun mount assembly. In this apparatus, the alignment of the electron gun is accomplished using a pulsed laser and an optical system to rotate the electron gun to the desired orientation.

U.S. Pat. No. 3,807,006 discloses a CRT envelope alignment assembly in which three reference surfaces of the assembly engage three reference surfaces of the envelope to align the horizontal and vertical axes of the envelope panel with the assembly axes. This patent also discloses an assembly which aligns the longitudinal axis of the envelope with a vertical axis of the assembly. The assemblies disclosed in this patent function as desired for many tubes. However, difficulties frequently arise because the panels and funnels from which a completed envelope is formed vary in size within a range of tolerances. The reference surfaces are not capable of accommodating such variations.

The instant invention overcomes this difficulty by the provision of an apparatus and method for aligning the envelope panel and electron gun mount assembly of a CRT which accommodates for the size variations of the panels and funnels caused by the allowable tolerances of the components.

SUMMARY OF THE INVENTION

Apparatus for aligning a cathode ray tube envelope with an electron gun mount assembly wherein the position and orientation of the gun mount assembly are referenced to fixed reference members includes means for supporting the envelope at a particular location with respect to the reference members. The neck of the envelope is engaged to orient the envelope with respect to the reference members. The envelope is positioned to a particular disposition with respect to the reference members whereby the envelope panel and the gun mount are referenced to said reference members to align the envelope panel and the gun mount. The means which positions the envelope is moveable with respect to the reference members to accommodate for dimensional changes caused by tolerances of the envelope.

DETAILED DESCRIPTION OF THE PREFERRED EMBODIMENT

Figure 1:
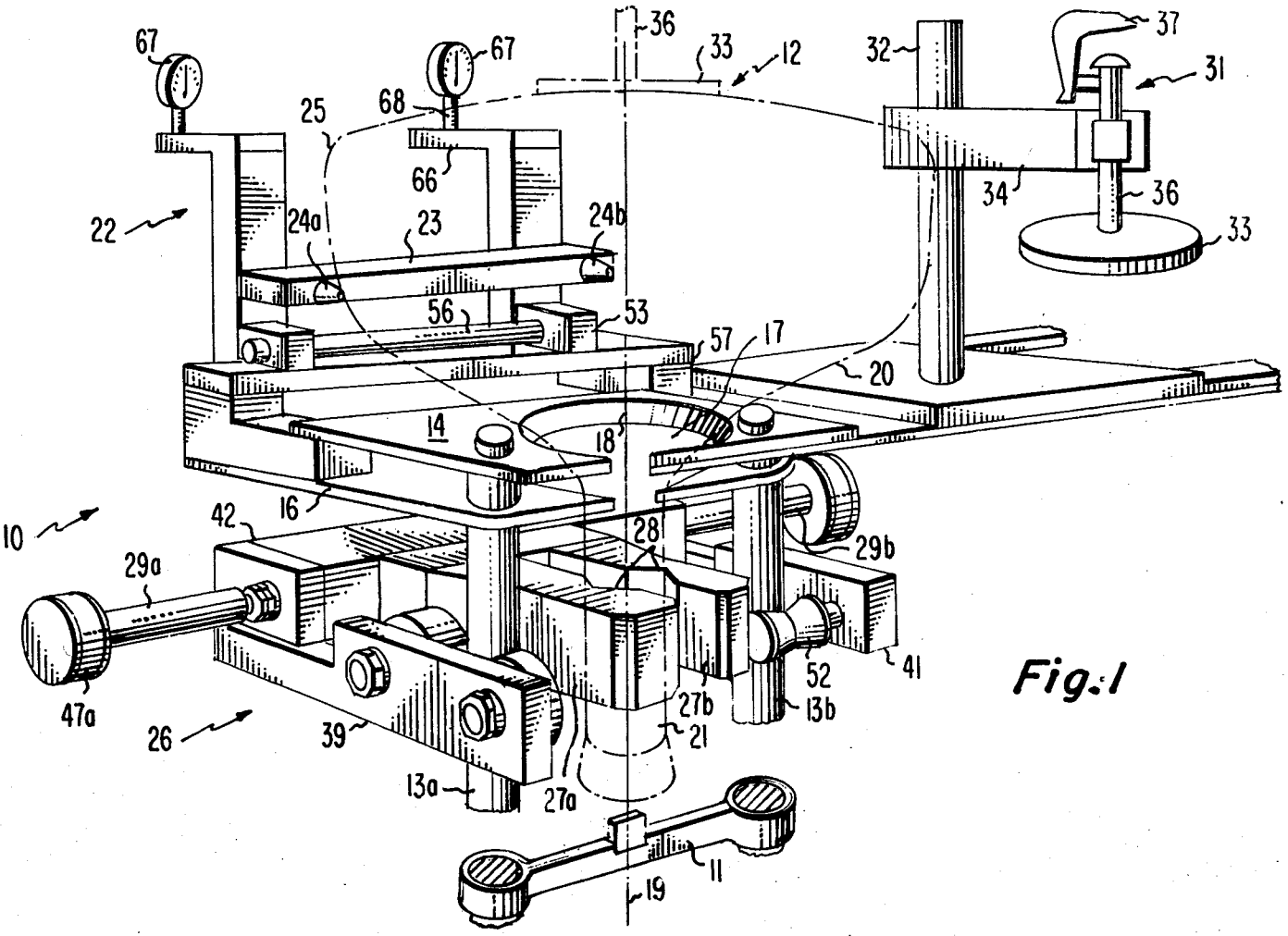
FIG. 1 is a perspective view partially broken away of a preferred embodiment.

In FIG. 1, the inventive apparatus 10 for aligning an electron gun mount assembly 11 and a CRT envelope 12 includes two fixed reference members 13*a* and 13*b* in the form of vertically extending parallel rods. The gun mount assembly 11 can be constructed and supported on the rods 13*a* and 13*b* in the manner described in U.S. Pat. No. 4,189,814. The position and orientation of the gun mount assembly 11 with respect to the rods 13*a* and 13*b* are precisely established. In the instant invention the position and orientation of a positioning mechanism 22 also are precisely established with respect to the rods 13*a* and 13*b*. Accordingly, in the invention, the gun mount assembly 11 and the CRT envelope 12 are referenced to the rods 13*a* and 13*b* and the alignment of the envelope and gun mount assembly is simple and accurate.

An upper support plate 14 and a lower support plate 16 are permanently affixed to the reference rods 13*a* and 13*b*. The upper support plate 14 includes an aperture 17 which has a beveled surface 18. The center of the aperture 17 lies on an axis 19 which is centered between and parallel to the center lines of the rods 13*a* and 13*b*. The funnel portion 20 of the envelope 12 is received by the aperture 17 so that the neck 21 of the envelope extends between the rods 13*a* and 13*b*. The support plate 14 therefore supports the envelope 12 in the vicinity of the axis 19 between the reference rods 13*a* and 13*b*.

Affixed to the support plates 14 and 16 is the positioning mechanism 22 which properly positions the funnel 20 of the envelope 12 with respect to a reference plane containing the center lines of the rods 13*a* and 13*b* and the axis 19. In a CRT, the three axes of the electron gun must be properly aligned with the corresponding three axes of the screen on the envelope panel to assure that the electron beams properly impact the multi-colored phosphors of which the screen is composed. This is accomplished by the use of a positioning bar 23 which is parallel to and spaced from the reference plane and which is perpendicular to the axis 19. The bar 23 supports two bumpers 24*a* and 24*b* which are equal in length so that the ends facing the aperture 17 are equal distant from the reference plane. The distance between the ends of the bumpers 24*a* and 24*b* and the reference plane is selected so that the bumpers engage one side of the envelope panel 25 when the envelope 12 is inserted into the aperture 17. Accordingly, when an envelope 12 is inserted into the aperture 17, the envelope is rotated until both of the bumpers 24*a* and 24*b* engage the same side of the panel 25 to align one side with the reference plane established by the rods 13*a* and 13*b*. The gun mount assembly 11 also is referenced to with the rods 13*a* and 13*b* so that the envelope panel and the gun mount are accurately aligned to one another. As described hereinafter with respect to FIG. 3, the positioning bar 23 is pivotably supported with respect to the reference plane and therefore the distance between the reference plane and the ends of the bumpers 24*a* and 24*b* is variable to accommodate for variations in panel size caused by dimensional tolerances.

An envelope orientation mechanism 26 also is referenced to the fixed reference rods 13*a* and 13*b*. The mechanism 26 includes two clamping members 27*a* and 27*b*, each of which includes a V-shaped groove 28. The clamping members 27*a* and 27*b* are equally spaced on opposite sides of the axis 19 and the apices of the V-shaped grooves 28 lie in the reference plane. The clamping members 27*a* and 27*b* are simultaneously moveable in opposite directions so that rotation of either the shafts 29*a* or 29*b* causes both members to move toward or away from one another at the same rate. The V-shaped grooves 28 engage the neck 21 of the envelope 12 to align the longitudinal axis of the envelope coincident with the axis 19. Details of the orientation mechanism 26 are presented hereinafter with respect to FIG. 2.

A holding mechanism 31 is pivotably mounted on a shaft 32 by a support 34. The mechanism 31 prevents movement of the envelope 12 after the envelope is properly positioned and oriented with respect to the rods 13*a* and 13*b*. The clamping mechanism 31 includes a clamping pad 33, or other type of holding device, which is moveable vertically on the support 34 through a shaft 36 and a lever 37. After the envelope 12 is properly positioned and oriented, the support 34 is pivoted about the shaft 32 to bring the clamping pad 33 into engagement with the faceplate of the envelope 12, as shown in phantom lines in FIG. 1. The lever 37 is then actuated to firmly press the clamping pad 33 against the faceplate.

In operation, initially the clamping members 27*a* and 27*b* are spread outwardly and the V-shaped grooves 28 can receive the neck 21 of an envelope 12. An envelope is inserted through the aperture 17 of the support plate 14 and the neck 21 of the envelope lies between the V-shaped grooves of the clamping members 27*a* and 27*b*. The beveled surface 18 of the aperture 27 engages the curved portion of the funnel 20 to center the envelope 12 with respect to the axis 19. The envelope is manually rotated about the longitudinal axis until one side of the panel 25 engages both of the bumpers 24 to align the envelope with the reference plane. The clamping members 27 are moved toward one another and the V-shaped grooves 28 engage the neck 21 and bring the longitudinal axis of the envelope into coincidence with the axis 19. At this time, because the center of the aperture 17, the ends of the bumpers 24 and 24*b* and the V-shaped grooves 28 are all referenced to the reference rods 13*a* and 13*b* all three axes of the envelope are properly positioned and oriented with respect to the rods 13*a* and 13*b*. Additionally, because the gun mount assembly 11 is referenced to the rods 13*a* and 13*b*, the gun mount assembly 11 and the envelope 12 are properly aligned with respect to one another. The insertion of the gun mount into the neck 21 of the CRT can be effected in the manner described in U.S. Pat. No. 4,189,814. After the envelope 12 is properly centered, positioned and oriented, the clamping pad 33 is brought into engagement with the surface of the envelope panel and the lever 37 actuated to firmly hold the envelope and prevent any movement. The clamping members 27 can then be disengaged from the neck 21 while the electron gun mount is inserted and the sealing of the envelope is completed.

Figure 2:
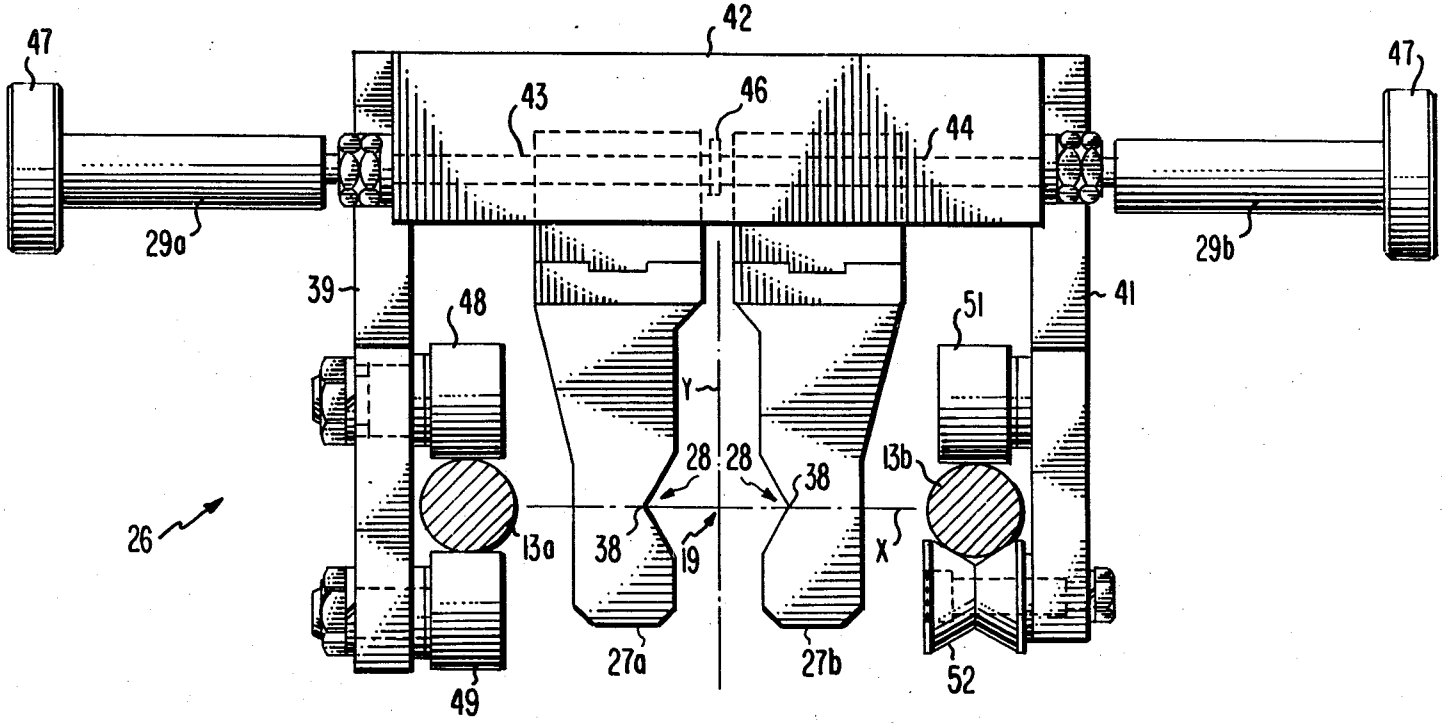
FIG. 2 is a top view of the members which orient the envelope panel with respect to the reference members.

FIG. 2 is a view looking straight down on the clamping mechanism 26 of FIG. 1. An X axis is coincident with the center lines of the reference rods 13*a* and 13*b* and a Y axis is perpendicular to the X axis and midway between the centers of the rods 13*a* and 13*b*. The vertical axis 19 of FIG. 1 lies at the intersection of the X and Y axes and extends perpendicular to the plane of the paper. The apices 38 of the V-shaped grooves 28 lie on the X axis, while the clamping members 27*a* and 27*b* are centered about the Y axis. Two side bars 39 and 41 are parallel to the Y axis and are coupled by a cross member 42 which is parallel to the X axis. A threaded member 43 is integral with the shaft 29*a* and is threaded into the clamping member 27*a*. A second threaded member 44 is integral with another shaft 29*b* and is threaded into the clamping member 27*b*. The two screws 43 and 44 are connected by a coupling 46 so that rotation of either of the shafts 29*a* or 29*b* results in the rotation of both of the screws 43 and 44. The screws 43 and 44 are oppositely threaded and the clamping members 27*a* and 27*b* are correspondingly threaded. Accordingly, rotation of one of the shafts 29*a* or 29*b* results in equal and opposite motion of the two clamping members 27*a* and 27*b*. The rotation can be affected manually with one of the knobs 47 or by an electric or other type of motor.

Two rollers, 48 and 49, are rotatably affixed to the side bar 39 and engage the reference rod 13*a*. Another roller 51 and a concave roller 52 are rotatably supported by the side bar 41 and engage the reference rod 13*b*. The concave shaping of the roller 52 prevents motion of the clamping mechanism 26 along the X axis. The use of the four rollers 48, 49, 51 and 52 prevents motion of the clamping mechanism 26 along the Y axis. The rollers 28, 49, 51 and 52 therefore maintain the centering of the clamping mechanism 26 with respect to the crossing of the three axis 19, X and Y. The rollers 48, 49, 51 and 52 allow vertical movement of the clamping mechanism 26 along the rods 13*a* and 13*b* so that the neck 21 can be engaged at a point remote from the funnel 20 to more accurately align the envelope along the axis 19. The vertical movement of the clamping mechanism 26 can be affected either manually or with any other convenient method and the manner of detenting the mechanism to the reference members 13 is within the purview of one skilled in the art.

Figure 3:
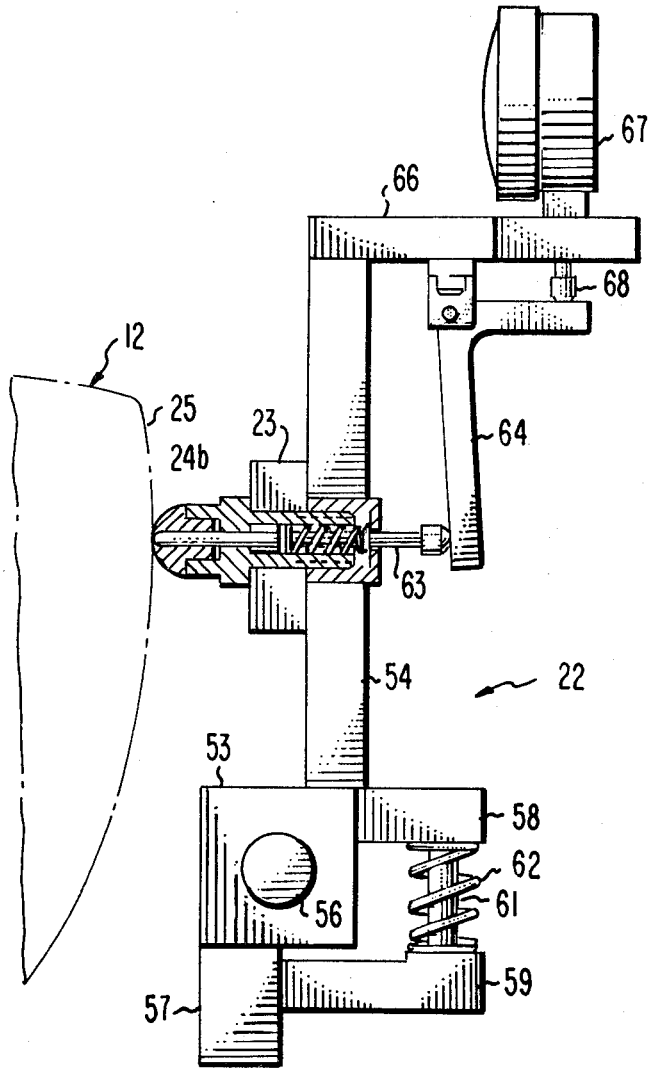
FIG. 3 is a side view of the means which positions the envelope panel in the particular disposition with respect to the reference members.

FIG. 3 is a sideview of the positioning mechanism 22 looking from the right of FIG. 1. The positioning bar 23, which supports the bumper 24*b*, is coupled to a support block 53 by a vertical post 54. The block 53 is rotatable about a shaft 56 and rests on a stop 57 which, as shown in FIG. 1, is permanently affixed to the lower support plate 16. A block 58 is integral with the base 53 and another block 59 is affixed to the stop 57. The blocks 58 and 59 are drilled to receive a pin 61 about which a spring 62 is arranged. The spring 62 acts between the two blocks 58 and 59 to bias the base 53 to a neutral position against the stop 57. The bumpers 24*a* and 24*b* are coupled by the positioning bar 23 and the bumpers simultaneously move equal distance with respect to the reference plane. The ability of the support block 53 to pivot about the shaft 56 permits the bumpers 24*a* and 24*b* to move with respect to the axis 19 and thus envelopes of slightly different sizes can be centered and oriented in the inventive mechanism. Accordingly, envelopes of a nominal size, but which vary within allowable tolerances, can be accommodated and accurately centered.

The bumper 24*b* accommodates a shaft 63, the end of which engages a pivotable angle 64. The shaft 63 is spring biased outwardly toward the envelope 12. The angle 64 is pivotably mounted to a horizontal support 66 which supports an indicator 67 having a shaft 68. The horizontal portion of the angle 64 engages the shaft 68 of the indicator 67. Accordingly, when an envelope panel 25 passes against the bumper 24*b*, the shaft 63 pivots the angle 64 against the indicator shaft 68 resulting in an indication on the indicator 67. As shown in FIG. 1, an indicator is associated with both of the bumpers 24*a* and 24*b* and therefore identical readings on the two indicators verifies the proper alignment of the envelope in the positioning mechanism 22. The engagement of the envelope panel 25 with the bumpers 24*a* and 24*b* aligns the envelope with respect to the positioning mechanism.

What is claimed is:

1. Apparatus for automatically aligning a cathode ray tube envelope with an electron gun mount assembly to be inserted into the neck of said envelope, wherein the position and orientation of said gun mount assembly are referenced to fixed reference means, said apparatus comprising:

means for supporting said envelope at a particular location with respect to said reference means;

means for engaging the neck of said envelope to orient said envelope with respect to said reference means; and means for positioning said envelope in a particular disposition with respect to said reference means whereby said envelope and said gun mount are referenced to said reference means to align said envelope to said gun mount, said means for positioning including a plurality of bumpers equally spaced from a plane containing said reference means and being pivotable with respect to said reference means whereby the distance between said reference plane and each of said bumpers is equally variable to accommodate for dimesional variations in said envelope due to dimensional tolerances.

2. The apparatus of claim 1 wherein said fixed reference means includes a plurality of parallel rods, said electron gun mount assembly being supported by said rods in a known position.

3. The apparatus of claim 2 wherein said means for positioning includes a plurality of simultaneously moveable bumpers arranged a preselected distance from said rods to engage the side of said envelope whereby said envelope is rotated to said particular disposition by said bumpers.

4. The apparatus of claim 3 wherein said simultaneously moveable bumpers are mechanically coupled.

5. The apparatus of claim 2 or 3 wherein said means for positioning rotates said envelope about the longitudinal axis to position the sides of said envelope with respect to said rods.

6. The apparatus of claim 3 wherein said means for supporting includes a support plate having an aperture centered with respect to said rods, whereby said aperture centers said envelope with respect to said rods.

7. The apparatus of claim 6 wherein said means for engaging includes clamping members for clamping the sides of said neck to orient said neck substantially parallel to said rods.

8. The apparatus of claim 7 further including means for holding the faceplate of said envelope to lock said envelope into the desired orientation with respect to said rods.

9. The apparatus of claim 5 wherein said means for supporting said envelope centers said envelope with respect to said rods.

10. The apparatus of claim 9 wherein said means for engaging tilts said envelope whereby the longitudinal axis of said envelope is coincident with and parallel to the center line between said rods.

11. The apparatus of claim 10 further including means for holding the faceplate of said envelope to lock said envelope into the desired orientation with respect to said rods.

12. The apparatus of claim 1 wherein said parallel extending members each support indicator means for indicating the alignment of said envelope with respect to said rods.

* * * * *